US008153915B2

(12) United States Patent
Eckert

(10) Patent No.: US 8,153,915 B2
(45) Date of Patent: Apr. 10, 2012

(54) CONTROL ELEMENT FOR A MOTOR VEHICLE

(75) Inventor: Gerold Eckert, Bad Neustadt a.d. Saale (DE)

(73) Assignee: PREH GmbH (DE)

( * ) Notice: Subject to any disclaimer, the term of this patent is extended or adjusted under 35 U.S.C. 154(b) by 276 days.

(21) Appl. No.: 12/531,774

(22) PCT Filed: Mar. 20, 2008

(86) PCT No.: PCT/EP2008/002256

§ 371 (c)(1),
(2), (4) Date: Nov. 11, 2009

(87) PCT Pub. No.: WO2008/113593

PCT Pub. Date: Sep. 25, 2008

(65) Prior Publication Data

US 2010/0108485 A1 May 6, 2010

(30) Foreign Application Priority Data

Mar. 22, 2007 (DE) ..... 10 2007 013 678

(51) Int. Cl.
*H01H 19/00* (2006.01)

(52) U.S. Cl. ..... 200/6 A

(58) Field of Classification Search ..... 200/5 A, 200/5 B, 5 C, 5 D, 5 E, 6 A, 553, 17 R
See application file for complete search history.

(56) References Cited

U.S. PATENT DOCUMENTS

| | | | | |
|---|---|---|---|---|
| 4,408,103 | A | 10/1983 | Smith | |
| 4,492,830 | A | 1/1985 | Kim | |
| 4,614,847 | A | 9/1986 | Sasao | |
| 6,359,243 | B1 | 3/2002 | Nakade | |
| 6,593,909 | B1 | 7/2003 | Chou | |
| 6,794,589 | B2 * | 9/2004 | Kubat et al. | 200/6 A |
| 6,974,920 | B2 * | 12/2005 | Yu | 200/6 A |
| 7,176,392 | B2 * | 2/2007 | Mimata et al. | 200/5 R |
| 7,745,744 | B2 * | 6/2010 | Nakase et al. | 200/6 A |

FOREIGN PATENT DOCUMENTS

| | | | |
|---|---|---|---|
| EP | 1164607 | A2 | 12/2001 |
| EP | 1426991 | A1 | 6/2004 |

OTHER PUBLICATIONS

International Search Report PCT/EP2008/002256; Dated Aug. 6, 2008.

* cited by examiner

*Primary Examiner* — Edwin A. Leon
(74) *Attorney, Agent, or Firm* — Cantor Colburn LLP

(57) ABSTRACT

A control element including at least four switches for electrical/electronic functions having a precise guidance for operation, where mount arms are disposed in a cross shape on their underside on a tip disposed in a housing, and on their top side in a spherical shell, and a pin is attached to the housing in each corner formed by the arms.

2 Claims, 1 Drawing Sheet

CONTROL ELEMENT FOR A MOTOR VEHICLE

TECHNICAL FIELD

The invention relates to control element comprising a key mounted pivotably about two spatial axes in a housing, with a ball-like guide being provided, which comprises four arms disposed on the key in a cross shape and a circuit board, which is associated with the key, and a contact mat disposed thereon.

BACKGROUND

The control elements according to the invention are used, for example, in vehicles for driving electrical and/or electronic components. These control elements are supposed to be able to trigger several functions, for example in order to reduce the number of control elements and/or to activate different functions assigned to a device. Such control elements are also known by the term toggle switch and are installed, for example, in steering wheels, for adjusting the external mirrors or the seat in motor vehicles.

DE 100 63 760 A1 describes a control element with an actuating element, wherein the latter is pivotable about two spatial axes. A sensor with a corresponding evaluation circuit is provided for detecting the movements of the actuating element. A control surface of the actuating element is provided with a trough-shaped depression for placing a finger of a hand therein. The advantages of a trackball are supposed to be thus combined with those of a joystick. The control element requires a complex electronic system and evaluation of the signals and is relatively tall when assembled.

US 2002/0066653 A1 describes an input device in which at least one key is disposed in a housing. The key is mounted in a spherical socket-shaped recess of the housing, with the key having a corresponding spherical underside. The key comprises four perpendicularly offset plungers pointing downwards in the housing, to which corresponding clearances in the housing are assigned. In order to actuate the key, it is pressed in a place where one of the plungers is disposed. Thus, the key is tilted and pushes the plunger through the corresponding clearance onto an associated switch. The guidance of the key is not very precise because actuation may result in faulty switching operations and/or jamming between two plungers.

A rocker switch designed for several tilting directions is known from U.S. Pat. No. 6,080,941, which is capable of triggering a dual-stage switching operation with each rocking direction. The rocker switch comprises a housing in which an interior space is formed in the shape of a spherical layer. A part of the rocker also formed as a spherical layer is guided in the spherical layer. Both spherical layers are configured such that the circumference of the spherical layers decreases from the lower sectional plane of the spherical layers towards the upper sectional layer. Thus, the rocker must be additionally supported in the downward direction. All the contacts and contact elements of the rocker switch are disposed on a silicone mat. Production of this known rocker switch is complex.

BRIEF DESCRIPTION

The disclosure provides a control element for motor vehicles which is capable of triggering a plurality of functions and which at the same is constructed in a simple manner and has a precise guidance for operation.

More specifically, a control element is provided comprising a key mounted pivotably about two spatial axes in a housing, with a ball-like guide being provided, which comprises four arms disposed on the key in a cross shape and a circuit board, which is associated with the key, and a contact mat disposed thereon. Because the arms are mounted on their underside on a tip disposed in the housing and on their top side in a spherical shell, they can be tilted by means of the key. In order to guide the tilting movements, a pin attached to the housing is disposed in each corner formed by the arms. This limits the tilting movements to the directions into which the arms extend. A reliable and simple guidance for operation is thus ensured.

The convex configuration of the sides of the arms at least in the area of the pins causes the pins to be able to touch the arms directly without a tilting movement transverse to the longitudinal direction of the arm concerned being impeded. A very exact guidance is thus possible.

The circular cross-section of the pins results in minimal contact areas between the pins and the arms and thus low friction, which improves the feel of the control element.

High stability is ensured by the conical configuration of the tip.

DESCRIPTION OF THE DRAWINGS

The invention is explained in detail below with reference to an example depicted in the drawings in a simplified manner. In the drawings.

DETAILED DESCRIPTION

Figure 1:
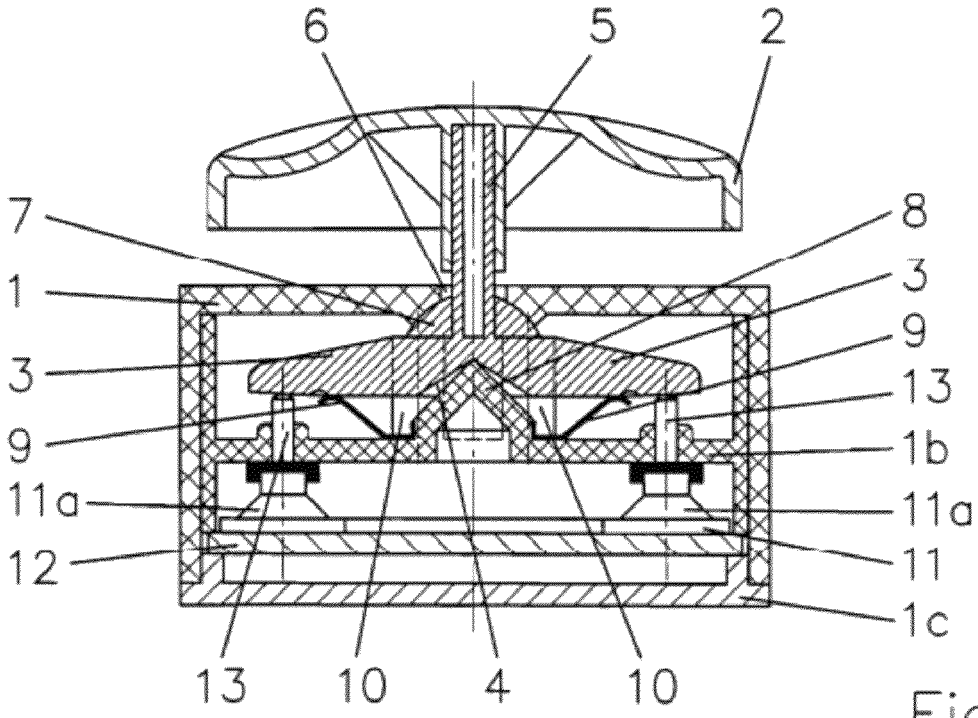
FIG. 1 shows a longitudinal section of a control element.
Figure 2:
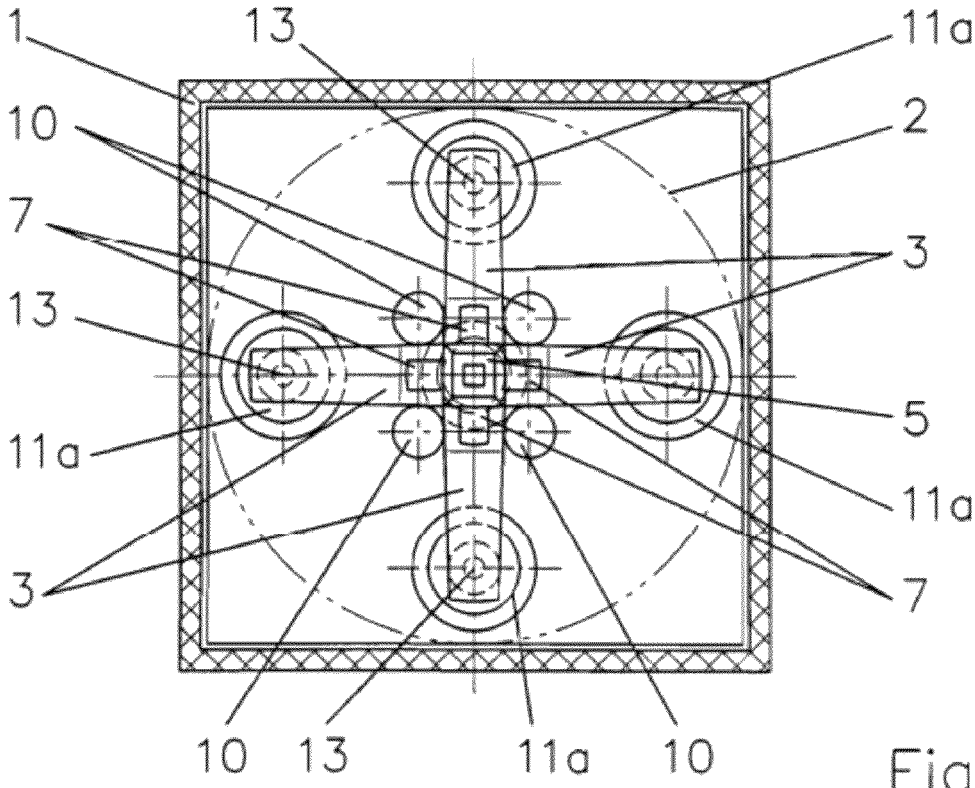
FIG. 2 shows a top view of the control element, with a key only being indicated and an upper part of a housing having been removed.

The specifications of directions relate to the Figures and do not relate to an assembly situation in a vehicle.

As is apparent from the Figures, a key 2 is disposed above a rectangular housing 1. The key is connected to four arms 3 centrically mounted in the housing 1, as seen from the top view.

An opening 6 is set centrically into the top of the housing 1, with a concentric area around the opening 6 being formed as a zone of a spherical shell on the inside of the housing 1.

A surface of the key 2 has in its peripheral area four trough-like depressions that are distributed offset at right angles and correspond to switching directions.

The arms 3 are disposed in the shape of a right-angled cross with equal legs. A conical depression 4 with an upwardly directed tapering is centrically recessed into the underside of the cross. A bar-shaped appendage 5 is formed opposite to the depression 4. The former protrudes through the opening 6. The key 2 is attached to the end of the appendage 5, for example by being snapped in. Directly adjacent to the appendage 5, a rib 7 in the form of a partial spherical layer is disposed on every arm 3. The external diameter of the ribs 7 corresponds to the internal diameter of the spherical shell.

The arms 3, the appendage 5 and the ribs 7 are made of one piece. The arms 3 are shaped convexly at their lateral flanks in an area close to the center.

An intermediate shelf 1*b* is disposed as a separate part of the housing 1 underneath the arms 3 between the upper and the lower side of the housing 1 and parallel relative to these sides. An upwardly pointing tip 8 in the shape of cone with a cylindrical base is formed centrally on the intermediate shelf 1*b*. The opening angle of the tip 8 is smaller than that of the depression 4. In this context, the difference between the opening angles is determined dependent on the switching distance required. A cross-shaped leaf spring 9 with four tongues is disposed between the intermediate shelf 1*b* and the arms 3 in such a way that each of the tongues extends parallel to an associated arm 3 and exerts a force acting upon it in the upward direction. Here, the leaf spring 9 is clamped onto the cylindrical base of the tip 8.

Four upwardly pointing pins 10 are formed on the intermediate shelf 1*b*. The pins 10 are disposed such that there is one of the pins 10 in each corner formed by the arms 3, the pin contacting the two adjacent arms 3. The pins 10 have a circular cross section, and, as regards their height, end flush with the upper edge of the arms 3 at the transition to the ribs 7.

A circuit board 12 is attached underneath and parallel relative to the intermediate shelf, and a contact mat 11 is attached directly on said circuit board. The contact mat 11 comprises four switching domes 11*a*. Each of the switching domes 11*a* is associated with one of the arms and placed underneath its end portion. A tappet 13 guided in a vertically displaceable manner in the intermediate shelf 1*b* is disposed between each switching dome 11*a* and the associated arm 3.

A lower part of the housing 1 is configured as a removable bottom 1*c*.

A detent groove can be recessed in an underside of each arm 3 between the end of the associated tongue of the leaf spring 9 and the tappet.

A covering can be disposed between the housing 1 and the key 2.

For actuation, an operator pushes the key 2 from a rest position into a direction corresponding to a desired function, with the corresponding trough aiding orientation. The push causes the key 2 and the arms 3 to tilt about the tip 8 and the corresponding arm 3 to be moved downwards. The corresponding switching dome 11*a* is thereby moved in a downward direction by the associated tappet 13, and a switching contact is established on the circuit board 10. Once the operator releases the key 2, the arms 3 and the key 2 are reset into the rest position because of the forces of the leaf spring 9 and/or of the switching dome 11*a*. In this case, it must be noted that the return force of the switching dome is basically sufficient for resetting the key 2 and the arms 3 into their initial position.

If, alternatively, the grooves are recessed into the arms 3, then an end of the tongue of the leaf spring 9 snaps into the associated groove during pushing. If necessary, the snapping action on the one hand permits enhancing the feel of the switching dome 11*a* and on the other hand supports a resetting action of the switching dome 11*a* if so required. Optionally, the detent spring 9 may also be omitted or can specifically be used as an additional detent as described above.

The invention claimed is:

1. Control element, comprising:

a key mounted pivotably about two spatial axes in a housing;

a ball-like guide comprising four arms disposed on the key in a cross shape and a circuit board which is associated with the key, and a contact mat disposed thereon;

wherein the arms are mounted on their underside on a tip disposed in the housing and on their top side in a spherical shell and wherein a pin with a circular cross section attached to the housing is disposed in each corner formed by the arms and wherein the arms, at least in the area of the pins, are configured in a convex manner.

2. Control element according to claim 1, wherein the tip is configured as a cone.

* * * * *